US005243784A

United States Patent [19]

Whitaker et al.

[11] Patent Number: 5,243,784

[45] Date of Patent: Sep. 14, 1993

[54] LIMIT SWITCH ARRANGEMENT FOR GARAGE DOOR OPERATOR

[75] Inventors: Louis G. Whitaker; Nicholas A. Dragomir, both of Alliance; Gregory E. Williams, Cuyahoga Falls; Thomas Angelini, Sebring, all of Ohio

[73] Assignee: GMI Holdings, Inc., Alliance, Ohio

[21] Appl. No.: 932,232

[22] Filed: Aug. 19, 1992

[51] Int. Cl.[5] ..... E05F 11/00

[52] U.S. Cl. ..... 49/199; 49/28; 49/360

[58] Field of Search ..... 49/199, 200, 360, 362, 49/139; 160/188, 193

[56] References Cited

U.S. PATENT DOCUMENTS

| | | | |
|---|---|---|---|
| 4,344,252 | 8/1982 | Suzuki et al. | 49/199 |
| 4,597,428 | 7/1986 | Iha | 49/199 X |
| 4,794,731 | 1/1989 | Willmott et al. | 49/199 |

FOREIGN PATENT DOCUMENTS 0460485 5/1991 European Pat. Off. .

*Primary Examiner*—Philip C. Kannan

*Attorney, Agent, or Firm*—Pearne, Gordon, McCoy & Granger

[57] ABSTRACT

A door operator for a reversibly operable door includes a frame and a carriage movably mounted on the frame and attached to a door for moving the door between open and closed positions. A drive member, specifically a roller chain, extends along the frame and moves the carriage. A drive train is provided within a housing and is connected for moving the drive member, and a control circuit is provided for controlling the drive train to open and close the door. A pair of limit switches is mounted within the housing and connected to the control circuit for stopping the drive train when the door has reached a completed position. A pair of limit cams are adjustably mounted on a limit wheel within the housing and separate from the carriage for engaging the limit switches. The limit wheel, which is separate from the drive member, is connected to the drive train to rotate when the drive train moves the carriage. The placement of limit switches and associated connecting wiring along the frame in the garage ceiling is eliminated. The limit cams can be easily and automatically positioned on the limit wheel by pushing a single switch without any manual movement of the limit switches or of the movable cams that contact the limit switches.

19 Claims, 6 Drawing Sheets

LIMIT SWITCH ARRANGEMENT FOR GARAGE DOOR OPERATOR

BACKGROUND OF THE INVENTION

1. Field of the Invention

This invention relates to automatic garage door operators, and more particularly to the control of the range of movement of door operators using adjustable limit switches.

2. Description of the Prior Art

Garage door operators are well known and are commonly used to open and close automatically upwardly acting overhead garage doors. These garage door operators, which are electric motor driven and usually remotely operated by radio control, provide considerable convenience to the motorist for powered, remote opening and closing of the garage door. The operators are usually actuated using a remote transmitting unit, which is typically carried in a vehicle, and is used to signal the controller of the garage door opener system to raise or lower the door, as the driver wishes.

Many different forms have been devised in the prior art to connect the door operator drive mechanisms to the garage door to be moved. Many garage doors are sectional garage doors of the overhead acting type which slide upwardly on a track to a position adjacent the ceiling of the garage. For these doors, the garage door operator includes a frame extending along the garage ceiling which provides a rail for a load carriage that moves longitudinally along the frame. A drive mechanism moves the load carriage, and in many instances, this drive mechanism includes a flexible drive member, and more particularly, a roller chain. The load carriage is pivotally connected to the top section of the sectional garage door. This same construction is also used with slab or one-piece garage doors which are pivoted to swing upwardly adjacent the garage ceiling when in an open position. In this manner, as the load carriage is driven back and forth by the drive mechanism along the frame, the garage door, which is attached to the load carriage, opens and closes.

It is necessary to stop the movement of the drive mechanism and the load carriage when the garage door has reached the fully opened or fully closed positions. For this purpose, limit switches have typically been provided adjacent to the frame. One limit switch was usually mounted along the forward end of the frame adjacent to the door, and this limit switch was engaged by the load carriage when the door was fully closed. Another limit switch was usually mounted along the other end of the frame adjacent to the drive train housing, and this limit switch was engaged by the load carriage when the garage door was fully opened. These limit switches provided an electrical signal when the load carriage had reached a desired opened or closed position, and this electrical signal was used by the controller of the garage door operator to halt the actuation of the drive mechanism.

Both of these limit switches needed to be adjustable along the length of the frame so that they could be set in any desirable position depending upon the size of the door and the geometry of the door travel. Due to varying geometries of garages, the position of the carriage when the door was fully opened or fully closed could not be preset, so the limit switches could be positioned at any desirable location along the frame to be engaged by the carriage when the door had reached the proper position. This feature prevented the limit switches from being securely fixed in place along the frame.

In order to engage the load carriage, these limit switches needed to be exposed. The location of the limit switches also required that each of the limit switches be connected to the controller within the housing by a length of wiring, and this wiring was also not fully protected. Furthermore, because the limit switches need to be adjustable, it is not easily possible to provide for a fixed protected enclosure for the limit switches or for the wiring. As a result, the limit switches and their wiring could be subjected to inadvertent or unintentional mistreatment, mishandling or abuse. Since the limit switches and the wiring were exposed in the garage ceiling, there was a possibility that they could be damaged. Furthermore, because the limit switches were intentionally adjustable, the limit switches could become loose and could be inadvertently moved from the desired set position. This inadvertent movement could result in undesirable incomplete opening or closing of the door and the need for readjustment. This required that limit switches be routinely monitored and adjusted to assure that they were in the proper position.

In addition, the positioning of the limit switches was a procedure that required a moderate amount of time or expertise. There was no automatic procedure for initially positioning the limit switches or for later re-positioning them if needed. The user or service technician would position the limit switches in a rough fashion and then adjust the position depending on the final movement of the door. This procedure required some expertise or necessitated repeated trial-and-error to position the limit switches in the precise desired position.

SUMMARY OF THE INVENTION

The present invention overcomes the problems of the prior art by providing an alternative arrangement for the placement of limit switches in garage door operators. The present invention provides an improvement in the garage door operators by providing a novel and unique arrangement in which the limit switches are placed within the housing that encloses the drive train, so that the exposed placement of the limit switches is avoided. According to the present invention, the limit switches are directly connected to the drive train and are engaged by a mechanism within the housing which moves in response to the movement of the drive train in the same manner as the movement of the load carriage.

The present invention eliminates the placement of limit switches along the frame in the garage ceiling, where the limit switches could be inadvertently struck or moved from their desired positions. The present invention no longer relies upon the contact of the limit switches by the carriage that moves along the frame.

In accordance with this invention, the limit switches are fully protected within the housing that also contains the motor and the control circuitry. Thus, the present invention eliminates the need for wiring extending outside the housing along the frame connecting external limit switches to the housing. With the limit switches located entirely internally within the housing, all such exposed wiring is eliminated.

The limit switches of the present invention are fully adjustable, but without the disadvantage of placing the limit switches in an exposed location in the ceiling of the garage where the position of the limit switches could be unintentionally changed through inadvertent contact with the limit switches.

The present invention also includes the capability of easily and automatically positioning the limit switches in the desired position so that the door operator is stopped when the door is fully opened and closed. This automatic setting of the limit positions can be accomplished simply by pushing a single switch without any manual movement of the limit switches or of the movable cams that contact the limit switches.

These and other advantages are provided by the present invention of a door operator for a reversibly operable door which comprises a frame and a carriage movably mounted on the frame and attached to a door for moving the door between open and closed positions. A drive member extends along the frame and is capable of moving the carriage. A drive train is connected for moving the drive member. Control means are provided for controlling the drive train to open and close the door. At least one limit switch is mounted and connected to the control means for stopping the drive train when the door has reached a completed position. A limit member is provided separate from the carriage for engaging the limit switch. Means which are connected to the drive train and which are separate from the drive member are provided for driving the limit member and engaging the limit switch when the door has reached the completed position.

Preferably, the door operator also includes a housing on the frame, and the limit switch and the limit member and the means for driving the limit member are all located within the housing, while the carriage is located outside of the housing.

DETAILED DESCRIPTION OF THE PREFERRED EMBODIMENT

Figure 1:
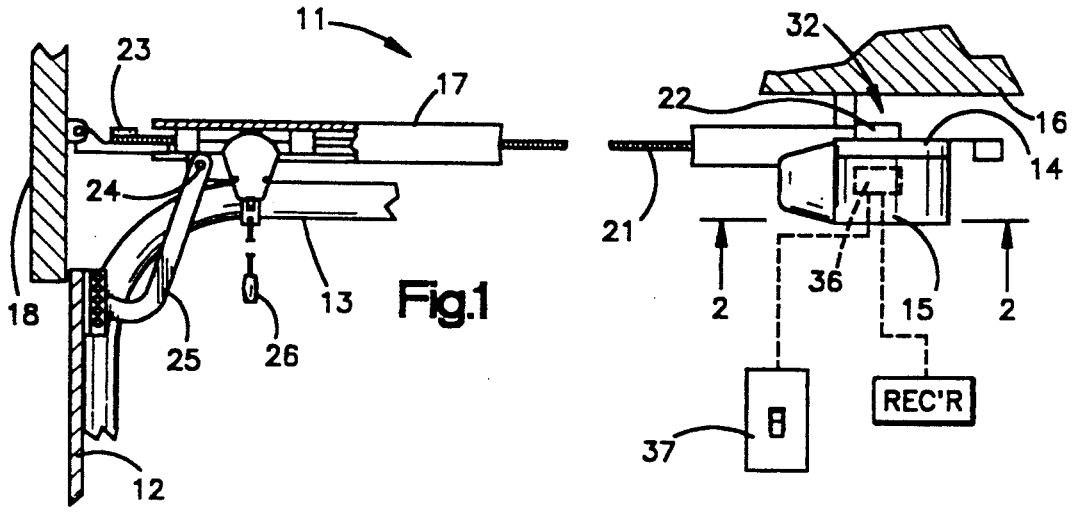
FIG. 1 is a side elevational view of a garage door operator incorporating the present invention.

Referring more particularly to the drawings, and initially to FIG. 1, there is shown a garage door operator 11 of the present invention. The operator 11 is used to move a garage door 12 between open and closed positions. The garage door 12 may be any of several types. An upwardly acting sectional garage door 12 is shown, in this case, a door made of a plurality of sections hinged together and rolling upwardly in a non-linear path with rollers in a curved track 13. The garage door may also be a solid one-piece or two-piece door which is pivoted to move to an open position adjacent the garage ceiling. The garage door operator 11 includes a frame 14 on which a housing 15 is mounted. The housing 15 contains an electric motor and a drive train connected to the motor. The housing 15 also contains control means in the form of a control circuit that operates the motor in response to various commands and control signals. The frame 14 is adapted to be fastened in any suitable manner to the ceiling 16 of the garage. A frame extension 17 extends from the frame 14 and is fastened to the header 18 of the garage above the door 12.

The motor within the housing 15 is connected to the garage door 12 by a drive member which may be, for example, a chain, a tape, a belt or a rotating screw. In this embodiment, the drive member is a roller chain 21. The drive train in the housing 15 includes an output or drive sprocket 22, and an idler sprocket or idler roller 23 is provided near the header end of the frame extension 17. The roller chain 21, which in this preferred embodiment is an endless chain, is trained around the drive sprocket 22 and the idler roller 23. A carriage 24 is guided for longitudinal sliding movement along the frame extension 17 and is releasably connected to the chain 21 to be propelled along the frame extension by the movement of the chain. An L-shaped door arm 25 is connected at one end to the carriage 24 and has a pivot connection at the other end to the top of the door 12. Engaging means may be provided to selectively engage and disengage the carriage 24 from the chain 21. The carriage 24 is connectable to and releasable from the chain 21 by a handle 26, and the handle may actuate a dog into the chain or tape. Preferably the endless chain 21 includes an engaging member which the dog of the handle 26 engages when the engaging member passes against the dog and the handle is positioned to permit the carriage 24 to be connected to the chain. Alternatively, if the drive member is a rotating screw instead of the chain 21, the handle 26 may actuate a partial nut into engagement with the rotatable drive screw. The disconnecting handle 26 is provided so that the garage door 12 may be disconnected from the operator 11 when desired, such as when electrical power is interrupted, and the door 12 can be operated manually.

Figure 2:
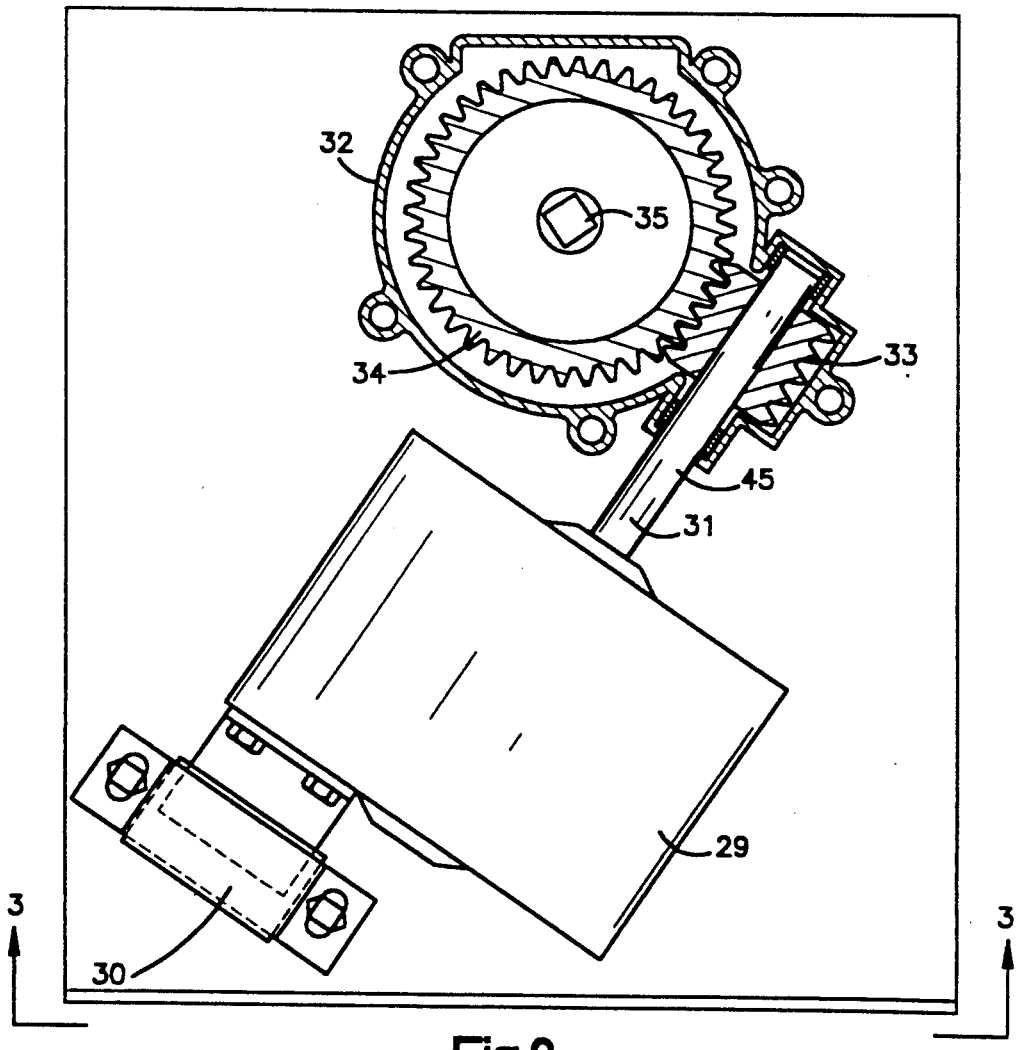
FIG. 2 is a bottom plan view of a portion of the garage door operator taken along line 2—2 of FIG. 1.

Some of the contents of bottom portion of the housing 15 may be seen with reference to FIG. 2. A motor 29 is mounted within the bottom portion of the housing 15 by means of a mounting assembly 30. A motor shaft 31 extends from the motor 29 and drives a drive train contained in a gear housing 32 within the housing 15. The drive train includes a drive worm 33 mounted on the motor shaft 31 which engages a helical gear 34. The helical gear 34 is mounted on a drive shaft 35. The drive shaft 35 extends upwardly within the housing 15, and the drive sprocket 22 is mounted on the drive shaft 35 on the top of the housing.

As indicated in FIG. 1, the housing 15 also contains the control circuit 36 which controls the operation of the motor 29 to open and close the garage door 12. The garage door operator 11 also typically includes a switch 37, such as a normally open, momentary closed switch like a doorbell push-button switch, and a remote radio transmitter which may be placed in an automobile, for example, to send a radio signal to a radio receiver 38 located in or near the housing 15. The switch 37 and the receiver 38 are connected to the control circuit 36 and are used to control the control circuit for initiating or stopping the opening or closing of the garage door 12. In response to signals received from the switch 37 or from the transmitter through the receiver 38, the control circuit 36 initiates action of the motor to open or close the garage door or discontinues action of the motor to stop movement of the door. Once the door starts moving, operation of the motor normally continues until the control circuit receives a signal from the switch 37 or from the transmitter through the receiver 38 to stop the movement of the door or until the control circuit receives a signal from a limit switch or from an obstruction detector to stop the operation of the motor because an obstruction is present.

Actuation of the motor 29 by the control circuit causes the motor shaft 34 to rotate which turns the drive worm 33 and rotates the helical gear 34 to turn the drive shaft 35. Rotation of the drive shaft 35 causes the drive sprocket 22 to rotate which causes the chain 21 to move. With the carriage 24 attached to the chain 21 the carriage slidably moves along the frame extension 17, and the garage door 12, which is attached to the carriage by the arm 25 is moved between open and closed positions.

Figure 4:
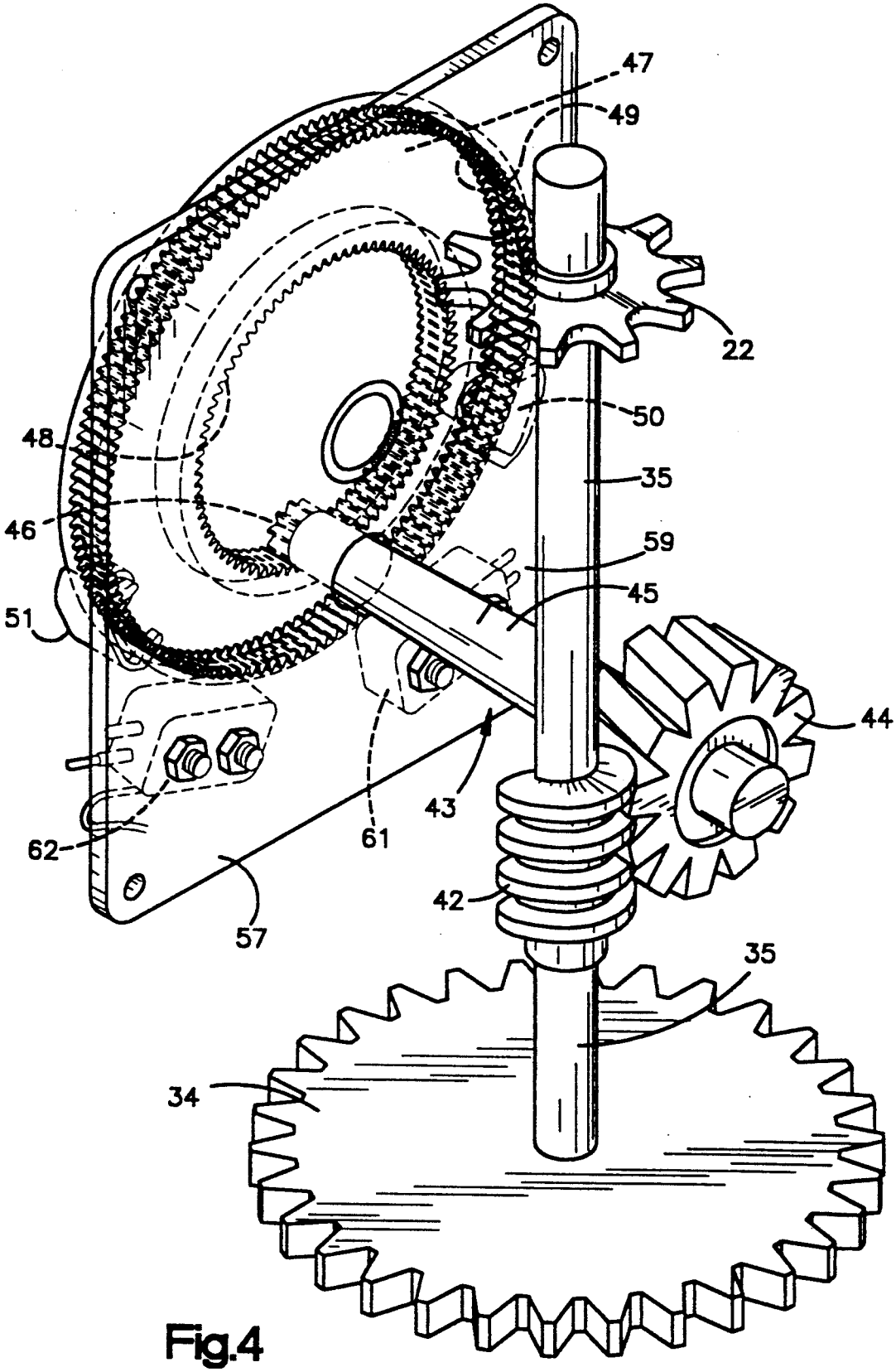
FIG. 4 is a perspective view of a portion of the drive train of the garage door operator.
Figure 5:
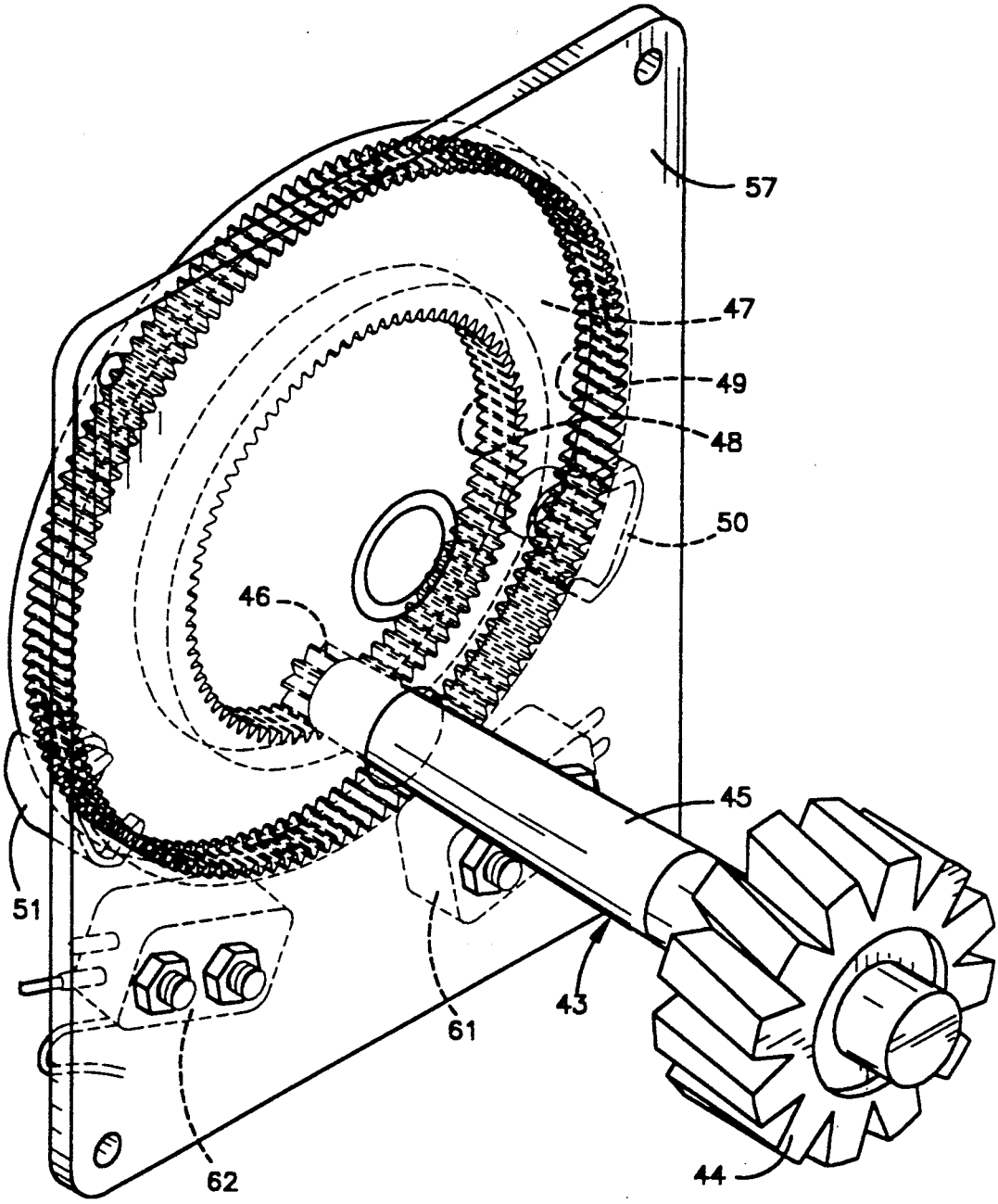
FIG. 5 is a perspective view of a portion of the drive train of FIG. 4.

As shown in FIG. 4, the drive shaft 35 extends from the helical gear 34 located in the lower portion of the housing to the drive sprocket 22 located at the top of the housing. A drive worm 42 is also mounted on the drive shaft 35 within the housing 15. The drive worm 42 engages a worm gear and pinon assembly 43. As shown in FIGS. 4 and 5, the worm gear and pinion assembly 43 comprises a helical worm gear 44, a shaft portion 45, and a pinion 46. The helical worm gear 44 engages the worm 42. The rotation of the worm gear 44 rotates the shaft portion 45 of the assembly which, in turn, rotates the pinion 46 which is formed on the end of the shaft portion.

Figure 3:
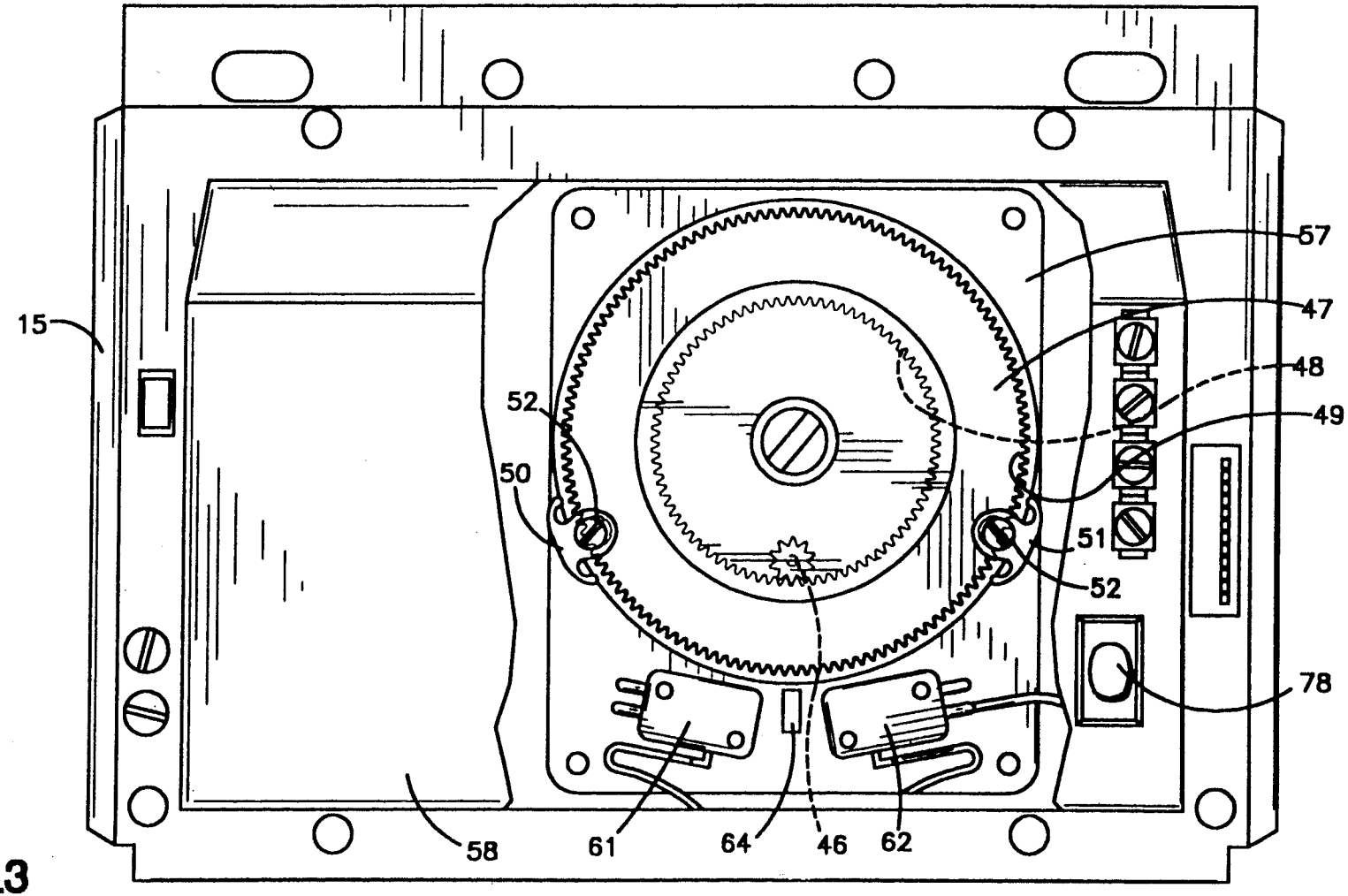
FIG. 3 is a rear elevational view of the garage door operator taken along line 3—3 of FIG. 2.
Figure 6:
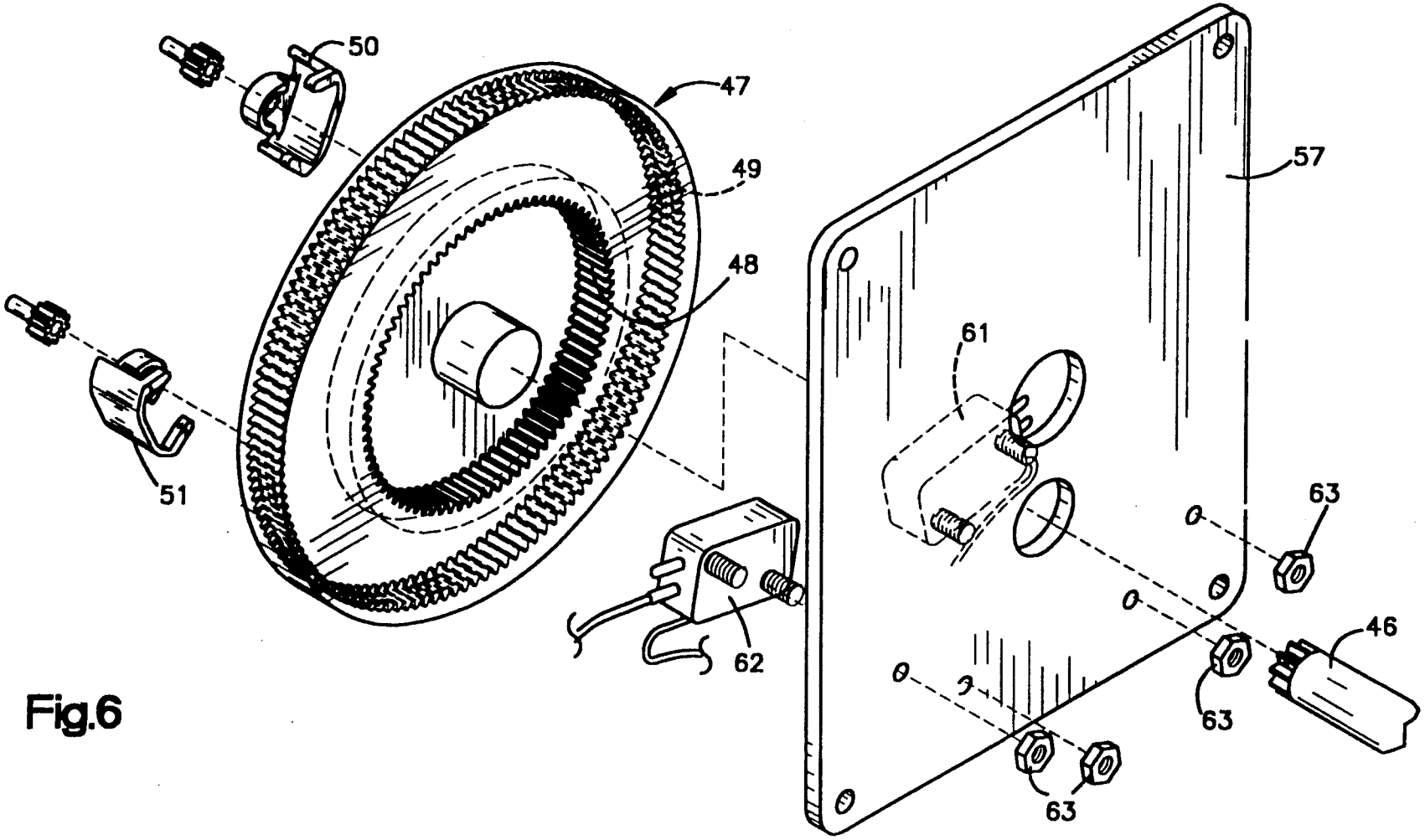
FIG. 6 is an exploded perspective view of a portion of FIG. 5.

The pinion 46 engages a limit wheel 47. As shown particularly in FIG. 6, the limit wheel 47 has an internal spur gear 48 on one side that is engaged by the pinion 46. On the other side the limit wheel 47 has a larger internal gear 49 (FIG. 3). A pair of limit cams 50 and 51 is movably mounted on the side of the limit wheel 47 by means of a pair of limit pinions 52 which engage the internal gear 49.

The limit wheel 47 is mounted on the gear housing 32 over a limit plate 57 which is also mounted on the gear housing. As shown in FIG. 3, the limit plate 57 is located inside the rear of the housing 15 and is covered by a rear housing panel 58. A pair of limit switches 61 and 62 is mounted to the limit plate 57 by means of fastening screws 63. The limit switches are mounted at set positions on the limit plate 57 during assembly of the operator and are not thereafter moved. A cam stop 64 is located on the limit plate 57 between the positions of the two limit switches 61 and 62.

Figure 8:
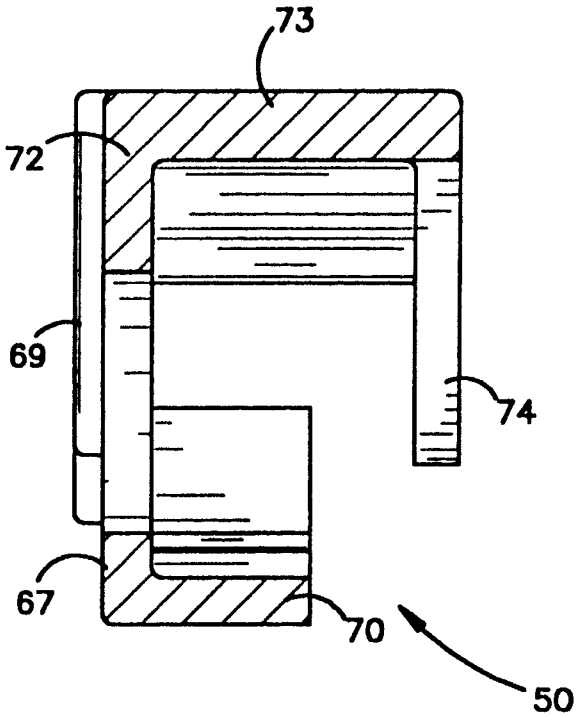
FIG. 8 is a sectional view of the limit cam taken along line 8—8 of FIG. 7.
Figure 7:
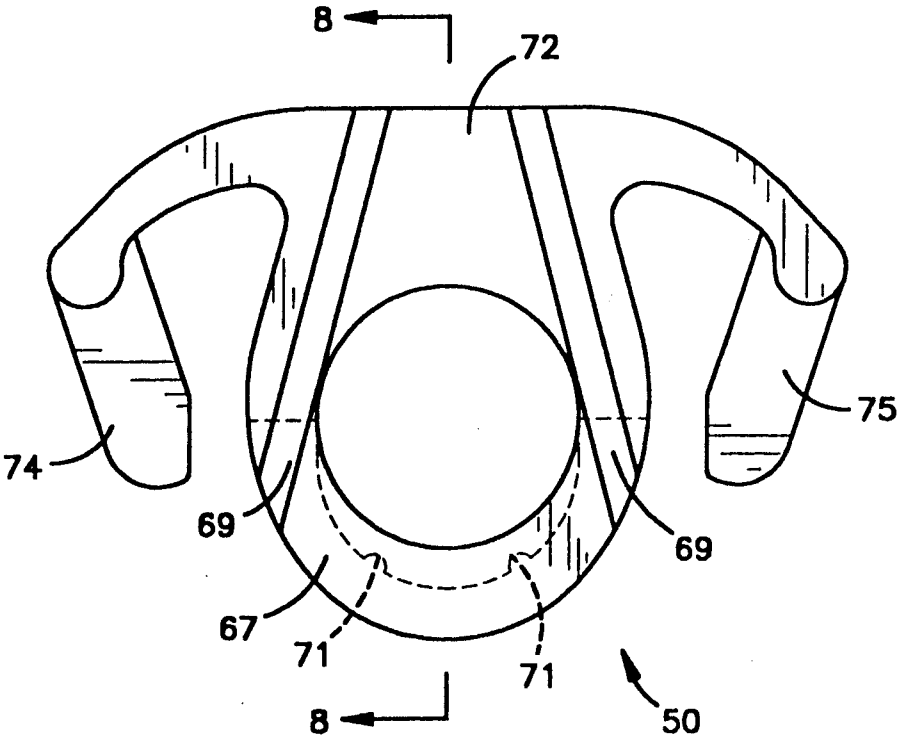
FIG. 7 is a detailed elevational view of the limit cam of FIG. 3 to a larger scale.

Both limit cams 50 and 51 are identical, and one of the limit cams 50 is shown in more detail in FIGS. 7 and 8. The limit cam 50 comprises a generally circular front disk portion 67 having a central circular opening 68 through which one of the limit pinions 52 is mounted. A pair of diagonally extending reinforcing ribs 69 is formed on the front surface of the disk portion 67. A curved engaging flange 70 extends inwardly at the bottom of the front disk portion 67. The flange 70 engages the limit pinion 52 and holds the pinion in contact with the internal gear 49 of the limit wheel 47. The inner surface of the engaging flange 70 has two small protrusions 71 which engage teeth of the associated limit pinion 52 to restrain the pinion from turning easily. A camming portion 72 extends upwardly from the front disk portion 67. The camming portion 72 engages one of the limit switches 61 and 62 when the limit cam 50 is mounted on the limit wheel 47. The camming portion 72 includes a shoulder portion 73 that extends inwardly from the front disk portion 67 and extends over the outer edge of the limit wheel 47 when the limit cam 50 is mounted on the limit wheel. A pair of mounting flanges 74 and 75 extends downwardly from the ends of the shoulder portion 73 and assist in holding the limit cam 50 onto the limit wheel 47.

With one of the limit pinions 52 engaging the internal gear 49 of the limit wheel 47, one of the limit cams 50 or 51 fits over the pinion 52 and over the outer edge of the limit wheel to hold the pinion in contact with the internal gear. At the same time the limit cam 50 or 51 is held in position on the edge of the limit wheel 47 by the engagement of the limit pinion 52, with the camming portion 72 of the limit cam extending radially beyond the outer edge of the limit wheel to engage one of the limit switches 61 and 62. Each of the limit cams 50 and 51 is thus held onto the limit wheel 47 along with its associated limit pinion 52 by an interference pressure fit between the limit cams, the limit pinions, and the outer edge and internal gear 49 of the limit wheel. The small protrusions 71 in each of the limit cams 50 and 51 engage teeth in the associated limit pinion 52 to prevent easy rotation of the limit pinion to hold the limit cam in position on the limit wheel 47.

As shown in FIG. 3, each of the limit pinions 52 is provided with an engaging slot similar to the slot normally provided on a screw head, so that the pinon can be engaged by a screwdriver or other similar tool and manually rotated. Although each of the limit pinions 52 are held against easy rotation by the protrusions on the limit cam 50 or 51, the limit pinions are also capable of being rotated over the protrusions to change the position of the limit cams on the limit wheel 47. Rotation of one of the limit pinions 52 moves the pinion along the internal gear 49 and changes the position of the pinion and of the associated limit cam 50 or 51 along the limit wheel 47. In this manner, the position of the limit cams 50 and 51 can be manually adjusted by engaging the slots on the limit pinions 52 and turning them. Preferably, the rear housing panel 58 is provided with suitable access openings so that the screwdriver slots on the limit pinions 52 can be engaged.

The worm 42 and worm gear 44 engagement provides a gear reduction whereby the worm gear rotates slower than the drive shaft 35. Similarly, the pinion 46 and internal gear 48 engagement provides another gear reduction whereby the limit wheel 47 rotates slower than the shaft portion 45. These gear reductions together cause the limit wheel 47 to rotate much slower than the drive shaft 35, and preferably, this gear reduction is arranged so that the limit wheel 47 completes less than one complete revolution as chain 21 moves the carriage 24 between the drive sprocket 22 and the idler roller 23. This design of the gear reduction permits the limit cams 50 and 51 to be properly positioned around the circumference of the limit wheel 47 and to engage the limit switches 61 and 62 upon less than one complete revolution of the limit wheel.

In the operation of the garage door operator 11 of the present invention, the control circuit 36 receives a signal through the receiver 38 from a remote transmitter or from an adjacent push-button switch 37 to begin movement of the garage door 12. If the garage door 12 is initially closed, the control circuit 36 causes the garage door to open when this signal is received. To open the garage door 12, the control circuit 36 actuates the motor 29 in a predefined direction of rotation, causing the motor shaft 31 to turn to drive worm 33. The drive worm 33 engages the helical gear 34, causing the drive shaft 35 to turn. The drive sprocket 22 on the drive shaft 35 rotates, moving the chain 21 and causing the carriage 24 Which is attached to the chain to move along the frame extension 17. The garage door 12 is attached to the carriage 24 through the arm 25, and movement of the carriage pulls the garage door open.

At the same time, rotation of the drive shaft 35 causes the worm 42 to rotate the worm gear 44 of the worm gear and pinon assembly 43. The rotation of the worm gear 44, in turn, causes the pinon 46 to rotate the limit wheel 47 through engagement of the internal gear 48.

The carriage 24 continues to move slidably along the frame extension 17 and the limit wheel 47 continues to rotate until the carriage approaches the drive sprocket 22. Before the carriage reaches the drive sprocket 22, the garage door 12 reaches its fully opened position and further movement of the carriage is unnecessary. At this point, one of the limit cams 50 is positioned to engage one of the limit switches 61. The limit switch 61 is connected to the control circuit 36, and the engagement of the limit switch causes a signal to be sent to the control circuit 36 indicating that the garage door 12 has reached its fully opened position. When the control circuit 36 receives this signal, it de-actuates the motor 29, stopping all further movement of the drive train.

With the door in the fully opened position, the receipt of a signal by the control circuit 36 from a remote transmitter through the receiver 38 or from the push-button switch 37 causes the control circuit 36 to begin operation of the motor 29 in the opposite direction. The operation of the motor 29 causes rotation of the motor shaft 31, the drive worm 33, the helical gear 34, the drive shaft 35, and the drive sprocket 22. Rotation of the drive sprocket 22 causes the chain 21 to move the carriage 24 toward the idler roller 23 to push the garage door 12 closed. The rotation of the drive shaft 35 also causes rotation of the worm 42, the worm gear 44, the pinion 46 and the limit wheel 47. Before the carriage 24 reaches the idler roller 23, the garage door 12 reaches its fully closed position. At this point, the other limit cam 51 is positioned on the limit wheel 47 to engage the other limit switch 62. The limit switch 62 is connected to the control circuit 36 to send a signal to the control signal when it is engaged, and the signal from this limit switch causes the control circuit 36 to stop the motor 29 and halt further action of the drive train.

The garage door operator 11 of the present invention is also provided with the capability of automatically positioning the limit cams 50 and 51 on the limit wheel 47. This capability includes the presence of a limit override/start switch 78 preferably located on the rear of the housing 15 as shown in FIG. 3. The limit override/-start switch 78 is connected to the control circuit 36, such that actuation of the switch 78 causes signals from the limit switches 61 and 62 to be ignored by the control circuit 36, thus causing the limit switches to be temporarily inoperative. For example, the limit override/start switch 78 can be wired in series with each of the limit switches 61 and 62 between the limit switches and the control circuit 36.

To set the proper position of the limit cam 50, the handle 26 should be positioned so that the dog in the carriage 24 is free to engage the chain. The garage door 12 then should be moved manually until the carriage 24 engages the chain 21. This leaves the garage door 12 in a partially open position. The limit override/start switch 78 is then actuated and held down, causing the control circuit 36 to run the motor 29 and drive train to open the door 12. Simultaneously, the limit wheel 47 rotates, and the limit cam 50 comes into contact with the limit switch 61. Since the limit override/start switch 78 is still activated, the limit switch 61 is temporarily inoperative, and the garage door 12 continues to open. The limit cam 50 moves slightly beyond the limit switch 61 but is prevented from further movement with the limit wheel 47 by engagement with the cam stop 64. With the limit wheel 47 continuing to rotate and with the limit cam 50 engaging the cam stop 64, the limit pinion 52 within the limit cam 50 begins to rotate, allowing the limit wheel 47 to continue to rotate while the limit cam 50 remains stationary. Thus, the limit cam 50 moves to a new position on the limit wheel 47. When the garage door 12 reaches the desired fully open position, the limit override/start switch 78 is released causing the limit switch 61 to signal the control circuit 36 to stop the motor 29. At this point, the limit cam 50 is at the proper position to engage the limit switch 61 when the garage door 12 is at the desired fully open position.

A similar procedure can be accomplished to position the other limit cam 51 for the door closed position. With the limit override/start switch 78 actuated and held down, the control circuit 36 causes the motor 29 and the gear train to close the garage door 12. Simultaneously, the limit wheel 47 rotates and eventually moves the limit cam 51 past the limit switch 62, which is temporarily inoperative, and into contact with the cam stop 64. With the limit wheel 47 continuing to rotate and with the limit cam 51 engaging the cam stop 64, the limit pinion 52 within the limit cam 51 begins to rotate, allowing the limit wheel 47 to continue to rotate while the limit cam 51 remains stationary. Thus, the limit cam 51 moves to a new position on the limit wheel 47. When the door 12 reaches the fully closed position, the control circuit 36 automatically stops and reverses the movement of the door through the actuation of door safety mechanisms that are well known in the art. When the motor 29 reverses, the direction of rotation of the limit wheel also reverses, and the limit cam 51 moves away from the cam stop 64. The limit override/start switch 78 is released, and the limit cam 50 is now positioned in the proper location for engagement of the limit switch 61 when the garage door is fully closed.

For fine adjustment of the limit cams 50 and 51, the screwdriver slots in the limit pinions 52 can be used. With the door 12 in the desired up or down position, a screwdriver can be inserted through appropriate Openings in the rear housing panel 58 and the limit pinion 52 may be rotated as needed. Moving the limit pinion 52 and the limit cam 50 or 51 closer to the cam stop 64 reduces the travel of the carriage 24, while moving the limit pinion and the limit cam away from the cam stop increases the carriage travel.

While the invention has been shown and described with respect to a particular embodiment thereof, this is for the purpose of illustration rather than limitation, and other variations and modifications of the specific embodiment herein shown and described will be apparent to those skilled in the art all within the intended spirit and scope of the invention. Accordingly, the patent is not to be limited in scope and effect to the specific embodiment herein shown and described nor in any other way this is inconsistent with the extent to which the progress in the art has been advance by the invention.

What is claimed is:

1. A door operator for a reversibly operable door, which comprises:

a frame;

a carriage movably mounted on the frame and attached to a door for moving the door between open and closed positions;

a drive member extending along the frame and capable of moving the carriage;

a drive train connected for moving the drive member;

control means for controlling the drive train to open and close the door;

at least one limit switch mounted and connected to the control means for stopping the drive train when the door has reached a completed position;

a limit member separate from the carriage for engaging the limit switch;

means continuously connected to the drive train and separate from the drive member for driving the limit member and engaging the limit switch when the door has reached the completed position; and means for automatically positioning the limit member to engage the limit switch when the door has reached the completed position without manual positioning of the limit member.

2. A door operator as defined in claim 1, wherein the means for driving the limit member rotates the limit member to engage the limit switch.

3. A door operator as defined in claim 2, wherein the limit member comprises a camming member mounted on a rotating wheel.

4. A door operator as defined in claim 1, comprising in addition a housing on the frame, the limit switch and the limit member and the means for driving the limit member being located within the housing, the carriage being located outside of the housing.

5. A door operator for a reversibly operable door, which comprises:

a frame;

a carriage movably mounted on the frame and attached to a door for moving the door between open and closed positions;

a drive member extending along the frame and capable of moving the carriage;

a drive train connected for moving the drive member;

control means for controlling the drive train to open and close the door;

at least one limit switch mounted and connected to the control means for stopping the drive train when the door has reached a completed position;

a limit member separate from the carriage for engaging the limit switch, the limit member comprising a camming member mounted on a rotating wheel in a desired position to engage the limit switch when the door has reached a desired location, the camming member being selectively movable with respect to the rotating wheel to allow the position in which the camming member engages the limit switch to be adjusted; and means connected to the drive train and separate from the drive member for driving the limit member and engaging the limit switch when the door has reached the completed position, the means for driving the limit member rotating the limit member to engage the limit switch.

6. A door operator as defined in claim 5, comprising in addition means for automatically positioning the camming member with respect to the rotating wheel to engage the limit switch when the door has reached the completed position.

7. A door operator as defined in claim 5, comprising in addition a housing on the frame, the limit switch and the limit member and the means for driving the limit member being located within the housing, the carriage being located outside of the housing.

8. A door operator for reversibly operable door, which comprises:

a frame;

a carriage movably mounted on the frame and attached to a door for moving the door between open and closed positions;

a drive member extending along the frame and capable of moving the carriage;

a housing mounted on the frame;

a drive train substantially within the housing connected for moving the drive member;

control means for controlling the drive train to open and close the door;

at least one limit switch mounted within the housing and connected to the control means for stopping the drive train when the door has reached a completed position; and a limit member within the housing for engaging the limit switch;

means within the housing continuously connected to the drive train for driving the limit member and engaging the limit switch when the door has reached the completed position; and means for automatically positioning the limit member to engage the limit switch when the door has reached the completed position without manual positioning of the limit member.

9. A door operator as defined in claim 8, wherein the housing is at one end of the frame.

10. A door operator as defined in claim 8, wherein the means for driving the limit member rotates the limit member to engage the limit switch.

11. A door operator as defined in claim 10, wherein the means for driving the limit member includes gear means in the housing directly connected to the drive train.

12. A door operator as defined in claim 10, wherein the limit member comprises a camming member mounted on a rotating wheel.

13. A door operator for a reversibly operable door, which comprises:

a frame;

a carriage movably mounted on the frame and attached to a door for moving the door between open and closed positions;

a drive member extending along the frame and capable of moving the carriage;

a housing mounted on the frame;

a drive train substantially within the housing connected for moving the drive member;

control means for controlling the drive train to open and close the door;

at least one limit switch mounted within the housing and connected to the control means for stopping the drive train when the door has reached a completed position; and a limit member within the housing for engaging the limit switch, the limit member comprising a camming member mounted on a rotating wheel in a desired position to engage the limit switch when the door has reached a desired location, the camming member being selectively movable with respect to the rotating wheel to allow the position in which the camming member engages the limit switch to be adjusted; and means within the housing connected to the drive train for driving the limit member and engaging the limit switch when the door has reached the completed position, the means for driving the limit member rotating the limit member to engage the limit switch.

14. A door operator as defined in claim 13, comprising in addition means for automatically positioning the camming member with respect to the rotating wheel to engage the limit switch when the door has reached the completed position.

15. A door operator as defined in claim 14, wherein the automatically positioning means includes means for temporarily disabling the limit switches and means for holding the camming member as the rotating wheel moves until the wheel reaches a desired position.

16. A door operator as defined in claim 13, wherein the housing is at one end of the frame.

17. A door operator as defined in claim 13, wherein the means for driving the limit member includes gear means in the housing directly connected to the drive train.

18. A door operator for a reversibly operable door, which comprises:

a frame;

a carriage movably mounted on the frame and attached to a door for moving the door between open and closed positions;

a drive member extending along the frame and capable of moving the carriage;

a housing mounted on the frame at one end on the frame;

a drive train substantially within the housing connected for moving the drive member;

control means for controlling the drive train to open and close the door;

a pair of limit switches mounted within the housing and connected to the control means for stopping the drive train when the door has reached a completed position;

a limit member within the housing separate from the carriage for engaging the limit switches, the limit member comprising a pair of camming members mounted on a rotating wheel;

means within the housing continuously connected to the drive train and separate from the drive member for rotating the wheel to cause one of the camming member to engage one of the limit switches when the door has reached the completed position; and means for automatically positioning the camming members to engage the limit switch when the door has reached the completed position without manual positioning of the camming members.

19. A door operator for a reversibly operable door, which comprises:

a frame;

a carriage movably mounted on the frame and attached to a door for moving the door between open and closed positions;

a drive member extending along the frame and capable of moving the carriage;

a housing mounted on the frame at one end on the frame;

a drive train substantially within the housing connected for moving the drive member;

control means for controlling the drive train to open and close the door;

a pair of limit switches mounted within the housing and connected to the control means for stopping the drive train when the door has reached a completed position; and a limit member within the housing separate from the carriage for engaging the limit switches, the limit member comprising a pair of camming members mounted on a rotating wheel in a desired position to engage one of the limit switches when the door has reached a desired location, each of the camming members being selectively movable with respect to the rotating wheel to allow the position in which each of the camming members engages one of the limit switches to be adjusted; and means within the housing connected to the drive train and separate from the drive member for rotating the wheel to cause one of the camming members to engage one of the limit switches when the door has reached the completed position.

* * * * *